US011441824B2

(12) United States Patent
Street et al.

(10) Patent No.: US 11,441,824 B2
(45) Date of Patent: Sep. 13, 2022

(54) SUBCRITICAL $CO_2$ REFRIGERATION SYSTEM USING THERMAL STORAGE

(71) Applicant: Hussmann Corporation, Bridgeton, MO (US)

(72) Inventors: Norman E. Street, O'Fallon, MO (US); Tobey D. Fowler, St. Charles, MO (US); Neil Monson, Bridgeton, MO (US); Wayne G. Schaeffer, Wildwood, MO (US)

(73) Assignee: Hussmann Corporation, Bridgeton, MO (US)

( * ) Notice: Subject to any disclaimer, the term of this patent is extended or adjusted under 35 U.S.C. 154(b) by 107 days.

(21) Appl. No.: 16/763,089

(22) PCT Filed: Nov. 10, 2017

(86) PCT No.: PCT/US2017/061169
§ 371 (c)(1),
(2) Date: May 11, 2020

(87) PCT Pub. No.: WO2019/094031
PCT Pub. Date: May 16, 2019

(65) Prior Publication Data

US 2020/0348056 A1 Nov. 5, 2020

(51) Int. Cl.
*F25B 25/00* (2006.01)
*F25B 9/00* (2006.01)

(52) U.S. Cl.
CPC ..... *F25B 25/005* (2013.01); *F25B 9/008* (2013.01); *F25B 2400/13* (2013.01);
(Continued)

(58) Field of Classification Search
CPC .... F25B 25/005; F25B 9/008; F25B 2400/13; F25B 2400/22; F25B 2400/23;
(Continued)

(56) References Cited

U.S. PATENT DOCUMENTS 501,490 A 7/1893 Burnett
785,129 A 3/1905 Uncapher
(Continued)

FOREIGN PATENT DOCUMENTS

EP 3139111 A1 * 3/2017 ..... F25B 25/005
WO WO2013144852 A1 10/2013
WO WO2016066980 A1 5/2016

OTHER PUBLICATIONS

International Search Report with Written Opinion for related Application No. PCT/US2017/061169 dated Aug. 1, 2018 (16 pages).

*Primary Examiner* — Miguel A Diaz
(74) *Attorney, Agent, or Firm* — Michael Best & Friedrich LLP

(57) ABSTRACT

A refrigeration system includes a primary refrigeration circuit configured to circulate a $CO_2$ primary refrigerant and a secondary refrigeration circuit separate from the primary refrigeration circuit. The primary refrigeration circuit includes a compressor assembly, a condenser assembly, a receiver, and one or more refrigeration loads having an evaporator assembly. The secondary refrigeration circuit includes a thermal storage unit and a heat exchanger. The thermal storage unit contains a phase change material. The secondary refrigeration circuit is in thermal communication with the primary refrigeration circuit through the heat exchanger. The primary refrigerant includes a critical temperature. The primary refrigeration circuit is configured for subcritical operation. The primary refrigeration circuit and the secondary refrigeration circuit are configured such that the phase change material provides cooling to the primary refrigerant during a first operating condition. The phase change material is configured to maintain subcritical operation of the primary refrigeration circuit during the first operating condition when the primary refrigerant is above the critical temperature.

21 Claims, 4 Drawing Sheets

(52) U.S. Cl.
CPC ..... *F25B 2400/22* (2013.01); *F25B 2400/24* (2013.01); *F25B 2600/2501* (2013.01)

(58) Field of Classification Search
CPC ..... F25B 2400/24; F25B 2600/2501; F25B 2309/06; F25B 2309/061
See application file for complete search history.

(56) References Cited

U.S. PATENT DOCUMENTS

| | | | | |
|---|---|---|---|---|
| 3,872,682 | A | 3/1975 | Shook | |
| 4,149,389 | A * | 4/1979 | Hayes | F25B 7/00 62/114 |
| 4,165,037 | A * | 8/1979 | McCarson | F24F 3/001 237/1 R |
| 4,498,289 | A | 2/1985 | Osgerby | |
| 5,090,209 | A | 2/1992 | Martin | |
| D501,490 | S | 2/2005 | Kerrigan | |
| 7,162,878 | B2 | 1/2007 | Narayanamurthy et al. | |
| 7,481,067 | B2 * | 1/2009 | Nakayama | F25B 9/008 62/222 |
| 8,186,171 | B2 * | 5/2012 | Heinbokel | F25B 9/008 62/224 |
| 8,316,654 | B2 * | 11/2012 | Heinbokel | F25B 7/00 62/79 |
| 8,789,380 | B2 | 7/2014 | Lesage et al. | |
| 8,887,524 | B2 | 11/2014 | Mihara | |
| 9,441,861 | B2 | 9/2016 | Diamond et al. | |
| 10,132,529 | B2 * | 11/2018 | Vaisman | F25B 49/02 |
| 10,309,693 | B2 * | 6/2019 | Zaynulin | F25B 6/04 |
| 10,443,900 | B2 * | 10/2019 | Kujak | F25B 5/04 |
| 2007/0001740 | A1 | 1/2007 | Shapiro | |
| 2007/0056312 | A1 * | 3/2007 | Kobayashi | F25B 9/008 62/335 |
| 2008/0264077 | A1 * | 10/2008 | Heinbokel | F25B 9/008 62/115 |
| 2008/0289350 | A1 | 11/2008 | Shapiro | |
| 2009/0133412 | A1 * | 5/2009 | Narayanamurthy | F24F 5/0017 62/66 |
| 2009/0293507 | A1 * | 12/2009 | Narayanamurthy | F24F 5/0017 62/59 |
| 2010/0043475 | A1 | 2/2010 | Taras et al. | |
| 2010/0071391 | A1 | 3/2010 | Lifson et al. | |
| 2010/0281894 | A1 | 11/2010 | Huff | |
| 2011/0138825 | A1 | 6/2011 | Chen et al. | |
| 2013/0298593 | A1 | 11/2013 | Christensen | |
| 2014/0150475 | A1 * | 6/2014 | Zaynulin | F25B 41/20 62/79 |
| 2014/0208785 | A1 | 7/2014 | Wallace et al. | |
| 2014/0230477 | A1 * | 8/2014 | Furui | F24F 5/00 62/238.6 |
| 2014/0338389 | A1 | 11/2014 | Ma et al. | |
| 2015/0069758 | A1 * | 3/2015 | Davidson | F01K 25/103 290/52 |
| 2016/0084552 | A1 | 3/2016 | Diamond et al. | |
| 2016/0146061 | A1 | 5/2016 | Kaira et al. | |
| 2017/0051950 | A1 * | 2/2017 | Uselton | F25B 9/008 |
| 2017/0176083 | A1 | 6/2017 | Sul et al. | |
| 2017/0219253 | A1 * | 8/2017 | Vaisman | F25B 9/008 |
| 2017/0299228 | A1 * | 10/2017 | Carter | F25B 49/02 |
| 2018/0087831 | A1 * | 3/2018 | Chou | F25D 31/006 |
| 2018/0142935 | A1 * | 5/2018 | Jacobi | F25B 13/00 |
| 2018/0209701 | A1 * | 7/2018 | Perrotin | F25B 25/005 |
| 2018/0340712 | A1 * | 11/2018 | Peter | F28D 20/02 |
| 2019/0162469 | A1 * | 5/2019 | Krishnamurthy | F25J 1/0227 |
| 2019/0203993 | A1 * | 7/2019 | Lesmerises | F25B 1/10 |
| 2019/0264933 | A1 * | 8/2019 | Ignatiev | F25B 13/00 |
| 2019/0316817 | A1 * | 10/2019 | Donovan | F25B 40/00 |
| 2019/0316818 | A1 * | 10/2019 | Spangler | F25B 40/00 |
| 2019/0368786 | A1 * | 12/2019 | Newel | F25B 40/02 |
| 2020/0124330 | A1 * | 4/2020 | Hayes | F25B 5/02 |
| 2020/0284477 | A1 * | 9/2020 | Hudson | F25B 49/027 |

* cited by examiner

SUBCRITICAL $CO_2$ REFRIGERATION SYSTEM USING THERMAL STORAGE

BACKGROUND

The present invention relates to a refrigeration system, and more specifically, to a refrigeration system using carbon dioxide refrigerant in refrigerated display cases in a commercial application.

A retail store, such as a supermarket, typically includes several refrigerated display cases or merchandisers for displaying and cooling food and/or beverage items that are offered for sale. Existing merchandisers include refrigeration systems to maintain a temperature within the product display area that is lower than ambient temperature inside the store.

Refrigerated merchandisers can employ different refrigerants to maintain the predetermined temperature range. Examples of refrigerants may include, but are not limited to, hydrofluorocarbons (HFC), perfluorocarbons (PFC), HFC blends (including R-404A and R-407A), and other hydrocarbon base refrigerants. However, there is a greater interest in using refrigerants that are more environment friendly, such as carbon dioxide. Because carbon dioxide has a low critical temperature, approx. 87.8° F. (31.1° C.), most refrigerant vapor compression systems charged with carbon dioxide refrigerant are designed for transcritical operation. During transcritical operation, the heat rejection heat exchanger operates as a gas cooler rather than a condenser and operates at a refrigerant temperature and pressure in excess of the refrigerant's critical point which is the point at which separate liquid and vapor phases no longer exists.

Transcritical $CO_2$ refrigeration systems have often consume more energy (kWh) than other refrigerant systems due to higher power draws (kW). This is directly related, at least in part, to the higher operating pressures required by $CO_2$ refrigerant. In addition, existing $CO_2$ systems often have system inefficiencies, including an undesirable fluid density change that occurs at a much lower temperature for $CO_2$ refrigerant relative to other refrigerants due to the pressure drop to vary the $CO_2$ refrigerant to the subcritical state. $CO_2$ transcritical systems also require higher costs of materials to withstand the higher overall pressures of $CO_2$ systems. In turn, labor costs are generally higher as well since more skilled technicians are required to work on such systems.

SUMMARY

In one embodiment, a refrigeration system includes a primary refrigeration circuit configured to circulate a CO2 primary refrigerant and a secondary refrigeration circuit separate from the primary refrigeration circuit. The primary refrigeration circuit includes a compressor assembly, a condenser assembly, a receiver, and one or more refrigeration loads having an evaporator assembly. The secondary refrigeration circuit includes a thermal storage unit and a heat exchanger. The thermal storage unit contains a phase change material. The secondary refrigeration circuit is in thermal communication with the primary refrigeration circuit through the heat exchanger. The primary refrigerant includes a critical temperature. The primary refrigeration circuit is configured for subcritical operation. The primary refrigeration circuit and the secondary refrigeration circuit are configured such that the phase change material provides cooling to the primary refrigerant during a first operating condition. The phase change material is configured to maintain subcritical operation of the primary refrigeration circuit during the first operating condition when the primary refrigerant would otherwise be above the critical temperature.

In another embodiment, a refrigeration system includes a CO2 refrigerant having a critical temperature. A receiver is configured to retain the CO2 refrigerant. One or more refrigeration loads having an evaporator assembly are in fluid communication with the receiver. A compressor assembly is in fluid communication with the refrigeration loads. A condenser assembly is in fluid communication with the compressor assembly. A thermal storage unit is in fluid communication with the condenser assembly and the receiver. The thermal storage unit includes a heat exchanger and phase change material. The phase change material provides cooling to the CO2 refrigerant during a first operating condition when the CO2 refrigerant is above the critical temperature. The CO2 refrigerant is configured to cool the phase change material during a second operating condition when the CO2 refrigerant would otherwise be below the critical temperature.

Another embodiment includes a method of controlling a refrigeration system including a CO2 refrigerant having a critical temperature. A receiver is configured to retain the CO2 refrigerant. One or more refrigeration loads having an evaporator assembly are in fluid communication with the receiver. A compressor assembly is in fluid communication with the refrigeration loads. A condenser assembly is in fluid communication with the compressor assembly. A thermal storage unit is in fluid communication with the condenser assembly and the receiver. The thermal storage unit includes a heat exchanger and phase change material. The CO2 refrigerant is directed to the thermal storage unit to cool the CO2 refrigerant with the phase change material during a first operating condition when the CO2 refrigerant is above the critical temperature. The CO2 refrigerant is directed to the thermal storage unit to charge the phase change material during a second operating condition when the CO2 refrigerant would otherwise be below the critical temperature.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially" or "approximately" are understood by those of ordinary skill to refer to reasonable ranges outside of the given value, for example, general tolerances associated with manufacturing, assembly, and use of the described embodiments.

Figure 1:
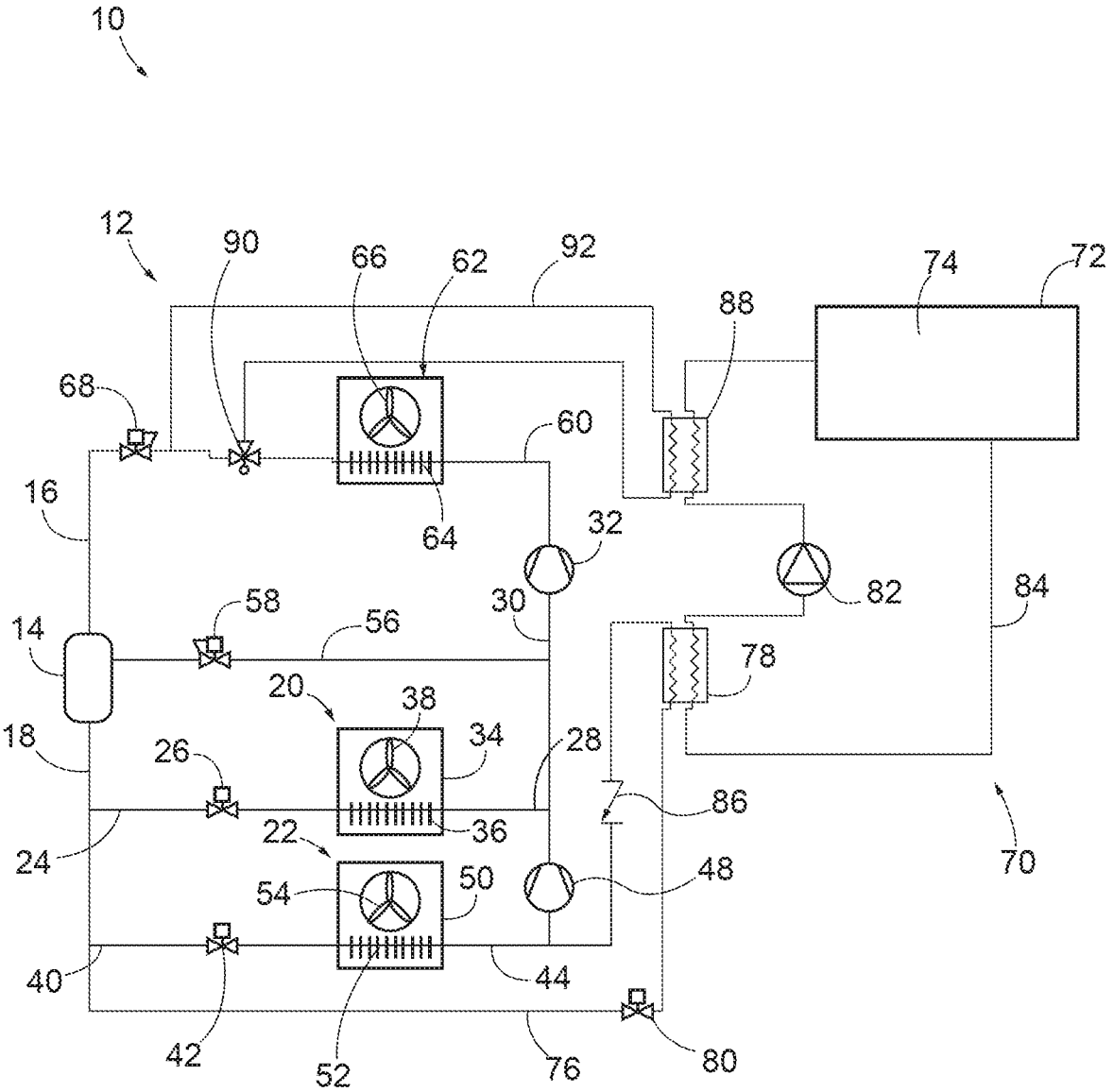
FIG. 1 is a schematic view of an exemplary subcritical $CO_2$ refrigeration system including a primary refrigeration circuit and a secondary refrigeration circuit that has a thermal storage unit with a phase change material.

FIG. 1 shows an exemplary embodiment of a refrigeration system 10 including a primary refrigeration circuit 12. The exemplary primary refrigeration circuit 10 circulates carbon dioxide ("$CO_2$") refrigerant as the primary refrigerant. The primary refrigeration circuit 12 includes a receiver 14 for collecting condensed primary refrigerant via an inlet conduit 16 and distributing the condensed primary refrigerant to one or more downstream loads (e.g., refrigerated merchandisers operating at the same or different temperatures) via an outlet conduit 18. As illustrated in FIG. 1, the refrigeration system 10 includes a medium temperature load 20 and a low temperature load 22 (e.g., representing medium temperature and low temperature refrigerated merchandisers, respectively, that are used in a commercial environment). The number and type of merchandisers can vary depending on the retail environment, and various exemplary embodiments can vary or eliminate the quantity of loads used in the primary refrigeration circuit 12.

A medium temperature conduit 24 branches off from the outlet conduit 18 to direct primary refrigerant to the medium temperature load 20. A medium temperature expansion valve 26 (e.g., an electronic expansion valve), is positioned between the receiver 14 and the medium temperature load 20 to regulate the pressure of the primary refrigerant flowing from the outlet conduit 18 to the medium temperature load 20. The medium temperature conduit 24 connects to a medium temperature exit conduit 28 downstream of the medium temperature load 20. The medium temperature exit conduit 28 connects to a first suction line 30 that leads to a first compressor assembly 32.

The medium temperature load 20 includes at least one medium temperature heat exchanger 34 (e.g., an evaporator assembly with a fin-tube heat exchanger 36 and a fan 38). The fan 38 directs air over the fin tube heat exchanger 36 to the interior of the medium temperature load 20. As the air passes through the fin-tube heat exchanger 36, it is cooled by the primary refrigerant to a temperature or temperature range suitable for conditioning product that is supported by the merchandiser. Although only a single medium temperature heat exchanger 34 is shown, other embodiments can include more than one medium temperature heat exchanger 34, with each medium temperature heat exchanger 34 connected in parallel or in series.

A low temperature conduit 40 branches off from the outlet conduit 18 to direct primary refrigerant to the low temperature load 22. A low temperature expansion valve 42 (e.g., an electronic expansion valve), is positioned between the receiver 14 and the low temperature load 22. The low temperature expansion valve 42 regulates the pressure of the primary refrigerant flowing from the outlet conduit 18 to the low temperature load 22. Downstream of the low temperature loads 22 A second suction line 44 connects to a second compressor assembly 48.

The low temperature load 22 includes at least one low temperature heat exchanger 50 (e.g., an evaporator assembly that includes a fin-tube heat exchanger 52 and a fan 54). The fan 54 directs air over the fin-tube heat exchanger 52 to the interior of the low temperature loads 22. As the air passes over the fin-tube heat exchanger 52, it is cooled by the primary refrigerant to a required temperature or temperature range. Although only a single low temperature heat exchanger 50 is shown, other embodiments can include more than one low temperature heat exchanger 50, with each low temperature heat exchanger 50 connected in parallel or in series. Certain embodiments can include one or more low temperature heat exchangers 50 associated with each low temperature load 22.

The first compressor 32 is located downstream of the second compressor 48. The second compressor 48 receives primary refrigerant from the second suction line 44 and compresses the primary refrigerant to an intermediate pressure. After exiting the second compressor 48 the primary refrigerant enters the first suction line 30 and then the first compressor 32. The first compressor 32 compresses the primary refrigerant from the intermediate pressure to a high pressure. In the illustrated embodiment, the first and second compressors 32, 48 are depicted as a single compressor for each load. Other embodiments can include multiple dedicated compressors for each load.

A bypass conduit 56 is coupled between the receiver 14 and the first suction line 30 downstream of the first compressor 32. The bypass conduit 56 can circulate the primary refrigerant from the receiver 14 to the first compressor 32 without passing through the medium temperature or low temperature loads 20, 22. In an exemplary embodiment, $CO_2$ vapor or gas is circulated from the receiver 14 to the first compressor 32 so that the refrigerant can be condensed into a liquid. A valve 58 controls the flow of the primary refrigerant through the bypass conduit 56.

After passing through the first compressor 32, the primary refrigerant enters a return conduit 60 and is directed to a condenser assembly 62 that includes a fin-tube heat exchanger 64 and a fan 66. As the compressed primary refrigerant enters the condenser assembly 62, the fan 66 directs air over the fin tube heat exchanger 64 to extract heat from the primary refrigerant. The condensed refrigerant is then discharged to the receiver 18. An expansion valve 68 is positioned downstream of the condenser assembly 62 and upstream of the receiver 14 to regulate the pressure of the primary refrigerant prior to entering the receiver 14.

The refrigeration system 10 also includes a secondary refrigeration circuit 70. The primary refrigeration circuit 12 and the secondary refrigeration circuit 70 are in thermal communication so that heat can be transferred from the primary refrigeration circuit 12 to the secondary refrigeration circuit 70 and from the secondary refrigeration circuit 70 to the primary refrigeration circuit 12 based on certain criteria or conditions as described in detail below.

The secondary refrigeration circuit 70 includes a thermal storage unit 72 containing a phase change material ("PCM") 74. The thermal storage unit 72 can include one or multiple containers or vessels connected together through piping. The PCM 74 can be charged by the primary refrigeration circuit 12 to cool and/or solidify the PCM 74. The PCM 74 can also be used to absorb heat from the primary refrigeration circuit 12. The primary refrigeration circuit 12 can charge the secondary refrigeration circuit 70 by cooling the PCM 74.

A charging conduit 76 branches off from the outlet conduit 18 to direct primary refrigerant to a charging heat exchanger 78. An expansion valve 80 (e.g., an electronic expansion valve) is positioned upstream from the charging heat exchanger 78 to regulate the pressure of the primary refrigerant entering the charging heat exchanger 78. The charging heat exchanger 78 provides cooling to the secondary refrigeration circuit 70. A secondary pump 82 is positioned in the secondary refrigeration circuit 70 to circulate a secondary refrigerant through the secondary refrigeration circuit 70. The secondary refrigeration circuit 70 includes a secondary refrigeration conduit 84 that contains the secondary refrigerant as it moves through the secondary refrigeration circuit 70. The secondary refrigerant solidifies the PCM 74 stored in the thermal storage unit 72. After passing through the charging heat exchanger 78, the secondary refrigerant passes through a check valve 86 and connects to the second suction line 44 downstream of the second compressor 48. Although the charging heat exchanger 78 is shown separate from the thermal storage unit 72, they can be incorporated into a common housing.

The secondary refrigeration circuit 70 can also be used to provide cooling to the primary refrigeration circuit 12. The secondary refrigeration circuit 70 includes a discharging heat exchanger 88 in thermal communication with the primary refrigeration circuit 12. The secondary refrigerant is circulated through the discharging heat exchanger 88 by the secondary pump 82. A three-way valve 90 is positioned in the inlet conduit 16 downstream of the condenser assembly 62. The primary refrigerant can be directed through the valve 90 into a condensing conduit 92 that enters the discharging heat exchanger 88. Heat from the primary refrigerant is passed to the secondary refrigerant in the discharging heat exchanger 88, which can cause the PCM 74 to change from a solid to a liquid. Although the charging heat exchanger 78 is shown separate from the thermal storage unit 72 and the discharging heat exchanger 88, one or more of these components can be incorporated into a common housing. Charging and discharging of the PCM 74 can also be accomplished in a single heat exchanger.

The primary refrigeration circuit 12 is configured for subcritical operation using a $CO_2$ refrigerant as the primary refrigerant. Subcritical operation of the primary refrigeration circuit 12 is partially dependent on the temperature of the ambient environment. If the temperature of the ambient environment goes above $CO_2$'s critical temperature, $CO_2$ will not fully condense in the condenser assembly 62 and the system becomes transcritical. The critical temperature of $CO_2$ is approx. 87.8° F. (31.1° C.), however real-world operating conditions and safety factors can require the critical temperature to be considered between approximately 75° F. and approximately 87° F. (23.9° C. and 30.6° C.). As the transcritical point is approached, the condenser assembly 62 is not capable of fully condensing the primary refrigerant. At this stage the condenser assembly 62 operates at least partially as a gas cooler or desuperheater to remove some of the heat from the primary refrigerant. Any non-condensed primary refrigerant is passed to the discharging heat exchanger 88 which acts as a subcritical condenser to absorb heat from, and fully condense, the primary refrigerant.

Under certain operating conditions, the primary refrigerant can be directed to the charging conduit 76 and through the charging heat exchanger 78 to charge the PCM 74 as needed. These operating conditions can include times of low ambient temperatures and/or times of low demand by the system.

Under certain conditions, it will not be feasible to operate the system shown in FIG. 1 as subcritical for longer than a specific period of time. For example, if the ambient temperature causes the primary refrigerant to rise above its critical temperature for an extended period of time, the PCM 74 will eventually lose the ability to condense the primary refrigerant. In such instances, the system can be configured run as a subcritical system in a first temperature range, as a transcritical system in a second temperature range that is greater than the first temperature range, and then again as a subcritical system in a third temperature range that is greater than the first temperature range. The different temperature ranges can be varied depending on the typical ambient temperatures for a given region, the overall requirements of the system, and/or on the amount of the PCM 74 and thermal properties of the PCM 74. In an exemplary embodiment, the first temperature range can be below approximately 77° F., the second temperature range can be in the range of approximately 77° F. to approximately 95° F., and the third temperature range can be above approximately 95° F.

In various exemplary embodiments, the thermal storage unit 72 can be incorporated into the condenser assembly 62. The thermal storage unit 72 can be in the same housing as the condenser assembly 62 and a series of valves (not shown) can be used to direct the primary refrigerant through the thermal storage unit 72 as needed prior to entering the condenser assembly 62 to cool the primary refrigerant. The valves can also be used to route the primary refrigerant through the thermal storage unit 72 after passing through the condenser assembly 62 to charge the PCM 74. Accordingly, a separate heat exchanger, for example a fin-tube heat exchanger, can be positioned in the thermal storage unit to transfer heat between the PCM 74 and the primary refrigerant.

The PCM 74 can include different substances and solutions with different formulations. The PCM 74 can include water based materials, including pure water, and brined solutions, or non-water based materials, including paraffins, salt hydrates, and vegetable based PCMs. PCM is also used as a general term, and not all PCMs go through a complete or significant phase-change (e.g., solid-to-solid PCMs). It would be understood by one of ordinary skill in the art that PCM 74 formulas can be adjusted to different temperatures, regions, and for different systems.

Figure 2:
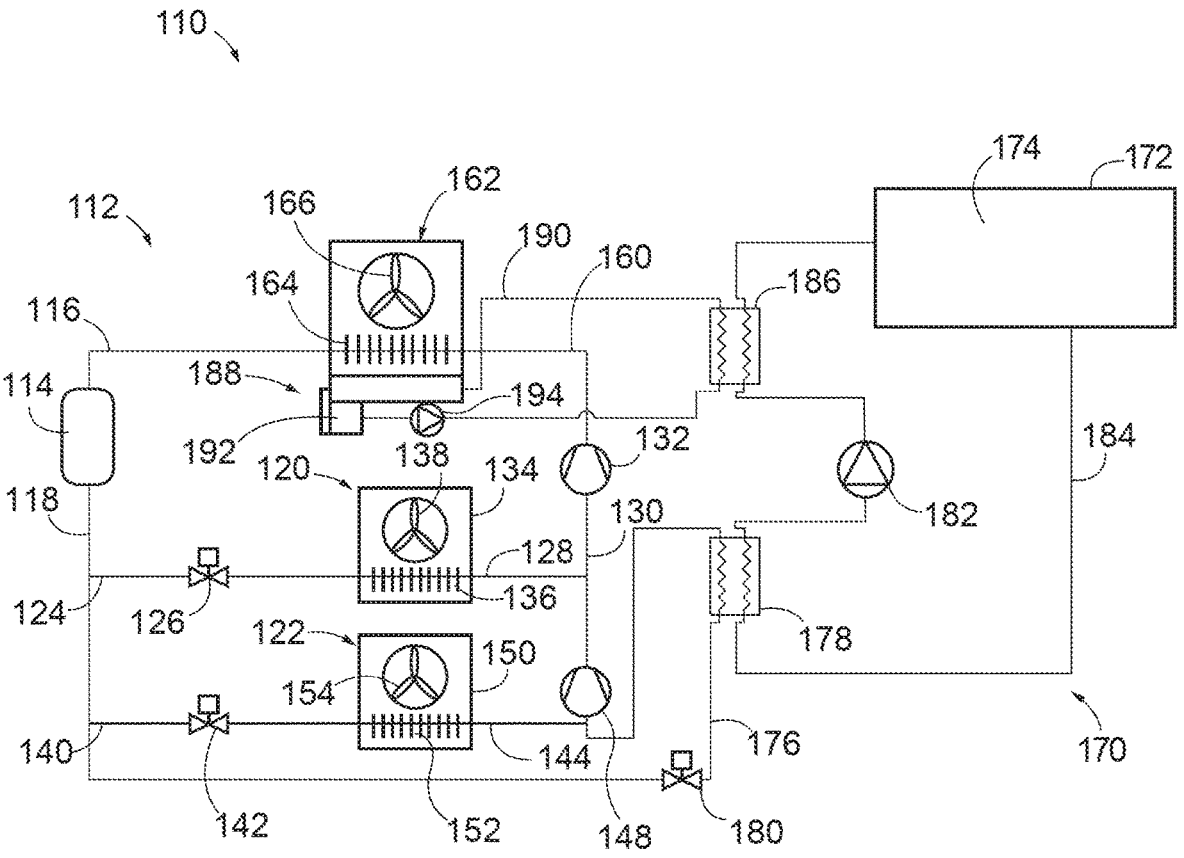
FIG. 2 is a schematic view of another exemplary subcritical $CO_2$ refrigeration system including a primary refrigeration circuit that has an adiabatic condenser and a secondary refrigeration circuit that has a thermal storage unit with a phase change material.

FIG. 2 shows an exemplary embodiment of a refrigeration system 110 including a primary refrigeration circuit 112. The exemplary primary refrigeration circuit 112 circulates $CO_2$ refrigerant as the primary refrigerant. The primary refrigeration circuit 112 includes a receiver 114 for collecting condensed primary refrigerant via an inlet conduit 116 and distributing the condensed primary refrigerant to one or more downstream loads (e.g., refrigerated merchandisers operating at the same or different temperatures) via an outlet conduit 118. As illustrated in FIG. 2, the refrigeration system 110 includes a medium temperature load 120 and a low temperature load 122 (e.g., representing medium temperature and low temperature refrigerated merchandisers, respectively, that are used in a commercial environment). The number and type of merchandisers can vary depending on the retail environment, and various exemplary embodiments can vary or eliminate the quantity of loads used in the primary refrigeration circuit 112.

A medium temperature conduit 124 branches off from the outlet conduit 118 to direct primary refrigerant to the medium temperature load 120. A medium temperature expansion valve 126 (e.g., an electronic expansion valve), is positioned between the receiver 114 and the medium temperature load 120 to regulate the pressure of the primary refrigerant flowing from the outlet conduit 118 to the medium temperature load 120. The medium temperature conduit 124 connects to a medium temperature exit conduit 128 downstream of the medium temperature load 120. The medium temperature exit conduit 128 connects to a first suction line 130 that leads to a first compressor assembly 132.

The medium temperature load 120 includes at least one medium temperature heat exchanger 134 (e.g., an evaporator assembly with a fin-tube heat exchanger 136 and a fan 138). The fan 138 directs air over the fin tube heat exchanger 136 to the interior of the medium temperature load 120. As the air passes through the fin-tube heat exchanger 136, it is cooled by the primary refrigerant to a temperature or temperature range suitable for conditioning product that is supported by the merchandiser. Although only a single medium temperature heat exchanger 134 is shown, other embodiments can include more than one medium temperature heat exchanger 134, with each medium temperature heat exchanger 134 connected in parallel or in series.

A low temperature conduit 140 branches off from the outlet conduit 118 to direct primary refrigerant to the low temperature load 122. A low temperature expansion valve 142 (e.g., an electronic expansion valve), is positioned between the receiver 114 and the low temperature load 122. The low temperature expansion valve 142 regulates the pressure of the primary refrigerant flowing from the outlet conduit 118 to the low temperature load 122. The low temperature conduit 140 connects to a second suction line 144 downstream of the low temperature loads 122 that leads to a second compressor 148.

The low temperature load 122 includes at least one low temperature heat exchanger 150 (e.g., an evaporator assembly that includes a fin-tube heat exchanger 152 and a fan 154). The fan 154 directs air over the fin-tube heat exchanger 152 to the interior of the low temperature loads 122. As the air passes over the fin-tube heat exchanger 152, it is cooled by the primary refrigerant to a required temperature or temperature range. Although only a single low temperature heat exchanger 150 is shown, other embodiments can include more than one low temperature heat exchanger 150, with each low temperature heat exchanger 150 connected in parallel or in series. Certain embodiments can include one or more low temperature heat exchangers 150 associated with each low temperature load 122.

The first compressor assembly 132 is located downstream of the second compressor 148. The second compressor 148 receives primary refrigerant from the second suction line 144 and compresses the primary refrigerant to an intermediate pressure. After exiting the second compressor 148 the primary refrigerant enters the first suction line 130 and then the first compressor assembly 132. The first compressor assembly 132 compresses the primary refrigerant from the intermediate pressure to a high pressure. In the illustrated embodiment, the first and second compressor assemblies 132, 148 are depicted as a single compressor for the each load. Other embodiments can include multiple dedicated compressors for each load.

After passing through the first compressor assembly 132, the primary refrigerant enters a return conduit 160 and is directed to a condenser assembly 162 that includes a fin-tube heat exchanger 164 and a fan 166. As the compressed primary refrigerant enters the condenser assembly 162, the fan 166 directs air over the fin tube heat exchanger 164 to extract heat from the primary refrigerant. This condenses the refrigerant prior to it being directed to the receiver 118. An expansion valve (not shown) positioned downstream of the condenser assembly 162 and upstream of the receiver 114 to regulate the pressure of the primary refrigerant entering the receiver 114.

The refrigeration system 110 also includes a secondary refrigeration circuit 170. The primary refrigeration circuit 112 and the secondary refrigeration circuit 170 are in thermal communication so that heat can be transferred from the primary refrigeration circuit 112 to the secondary refrigeration circuit 170 and from the secondary refrigeration circuit 170 to the primary refrigeration circuit 112 based on certain criteria or conditions as described in detail below.

The secondary refrigeration circuit 170 includes a thermal storage unit 172 containing a phase change material ("PCM") 174. The PCM 174 can be charged by the primary refrigeration circuit 112 to cool and/or solidify the PCM 174. The PCM 174 can also be used to absorb heat from the primary refrigeration circuit 112. The primary refrigeration circuit 112 can charge the secondary refrigeration circuit 170 by cooling the PCM 174.

A charging conduit 176 branches off from the outlet conduit 118 to direct primary refrigerant to a charging heat exchanger 178. An expansion valve 180 (e.g., an electronic expansion valve) is positioned upstream from the charging heat exchanger 178 to regulate the pressure of the primary refrigerant entering the charging heat exchanger 178. The charging heat exchanger 178 provides cooling to the secondary refrigeration circuit 170. A secondary pump 182 is positioned in the secondary refrigeration circuit 170 to circulate a secondary refrigerant through the secondary refrigeration circuit 170. The secondary refrigeration circuit 170 includes a secondary refrigeration conduit 184 that contains the secondary refrigerant as it moves through the secondary refrigeration circuit 170. The secondary refrigerant solidifies the PCM 174 stored in the thermal storage unit 172. After passing through the charging heat exchanger 178, the secondary refrigerant enters the second suction line 144 downstream of the second compressor assembly 148. Although the charging heat exchanger 178 is shown separate from the thermal storage unit 172, they can be incorporated into a common housing.

The secondary refrigeration circuit 170 can also be used to provide cooling to the primary refrigeration circuit 112 through the condenser assembly 162. The secondary refrigeration circuit includes a discharging heat exchanger 186 in thermal communication with the primary refrigeration circuit 112. The secondary refrigerant is circulated through the discharging heat exchanger 186 by the secondary pump 182. The condenser assembly 162 includes an adiabatic cooler 188 having a condenser conduit 190 that runs through the discharging heat exchanger 186. A condenser coolant 192 is circulated through the condenser conduit 190 by a condenser pump 194. Heat from the condenser coolant 192 is passed to the secondary refrigerant in the discharging heat exchanger 186, which can cause the PCM 174 to change from a solid to a liquid. The cooled condenser coolant 192 is circulated through the condenser assembly 162 to provide greater cooling to the primary refrigerant.

The primary refrigeration circuit 112 is configured for subcritical operation using a $CO_2$ refrigerant as the primary refrigerant. Subcritical operation of the primary refrigeration circuit 112 is partially dependent on the temperature of the ambient environment. As discussed above, if the temperature of the ambient environment goes above $CO_2$'s critical temperature, $CO_2$ will not fully condense in the condenser assembly 162 and the system becomes transcritical. As the transcritical point is approached, the adiabatic cooler 188 can be activated to provide additional cooling through the condenser assembly 162 and fully condense the primary refrigerant.

Under certain operating conditions, the primary refrigerant can be directed to the charging conduit 176 and through the charging heat exchanger 178 to charge the PCM 174 as needed. These operating conditions can include times of low ambient temperatures and/or times of low demand by the system.

Under certain conditions, it will not be feasible to operate the system shown in FIG. 2 as subcritical for longer than a specific period of time. For example, if the ambient temperature causes the primary refrigerant to rise above its critical temperature for an extended period of time, the PCM 174 will eventually lose the ability to condense the primary refrigerant. In such instances, the system can be configured run as a subcritical system in a first temperature range, as a transcritical system in a second temperature range that is greater than the first temperature range, and then again as a subcritical system in a third temperature range that is greater than the first temperature range. The different temperature ranges can be varied depending on the typical ambient temperatures for a given region, the overall requirements of the system, and/or on the amount of the PCM 174 and thermal properties of the PCM 174. In an exemplary embodiment, the first temperature range can be below approximately 77° F., the second temperature range can be in the range of approximately 77° F. to approximately 95° F., and the third temperature range can be above approximately 95° F.

In various exemplary embodiments, the thermal storage unit 172 can be incorporated into the condenser assembly 162. The thermal storage unit 172 can be in the same housing as the condenser assembly 162 and a series of valves (not shown) can be used to direct the primary refrigerant through the thermal storage unit 172 as needed prior to entering the condenser assembly 162 to cool the primary refrigerant. The valves can also be used to route the primary refrigerant through the thermal storage unit 172 after passing through the condenser assembly 162 to charge the PCM 174. Accordingly, a separate heat exchanger, for example a fin-tube heat exchanger, can be positioned in the thermal storage unit to transfer heat between the PCM 174 and the primary refrigerant.

Figure 3:
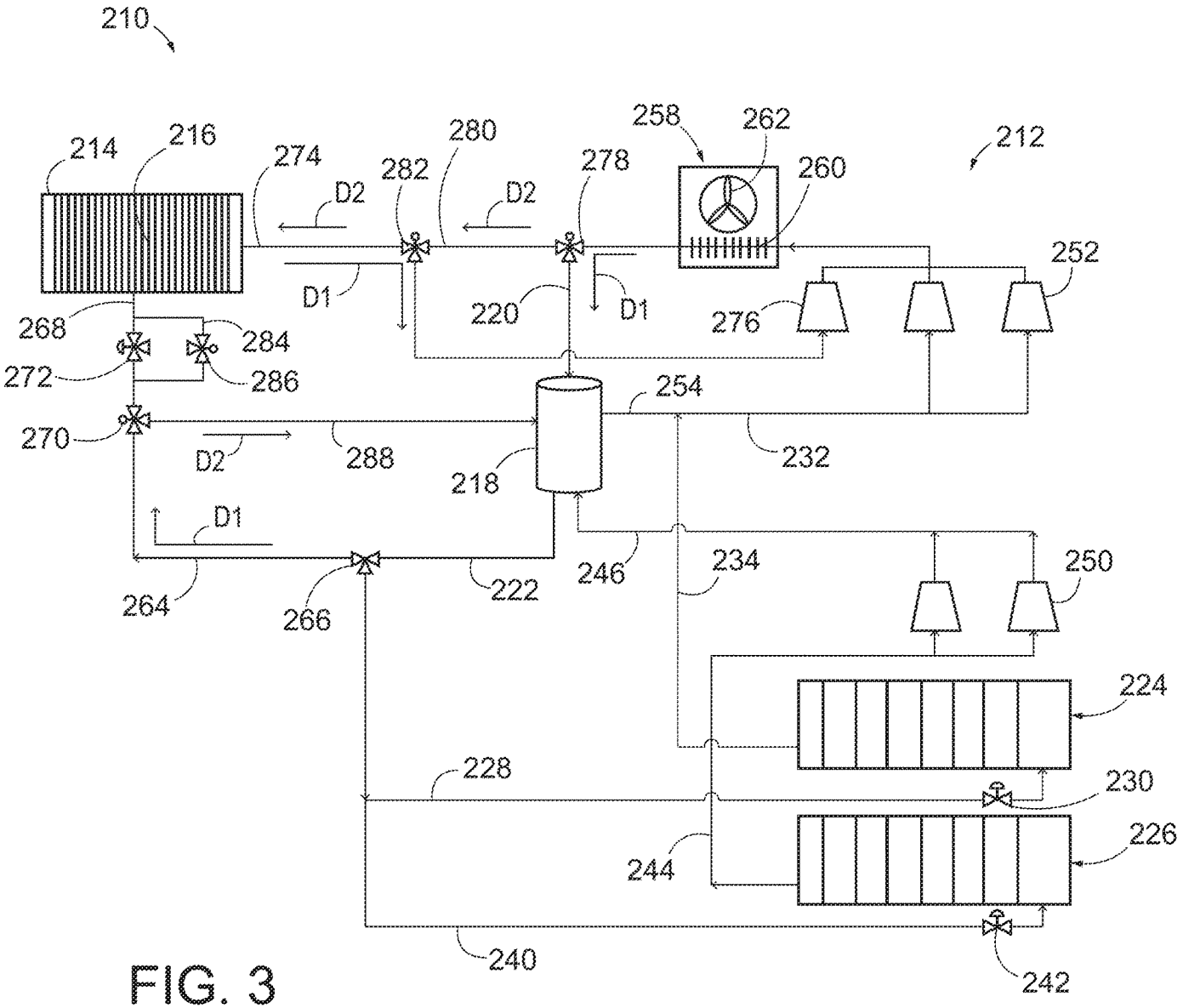
FIG. 3 is a schematic view of another exemplary subcritical $CO_2$ refrigeration system including a refrigeration circuit that has an integrated thermal storage unit with a phase change material.

FIG. 3 shows an exemplary embodiment of a refrigeration system 210 that circulates $CO_2$ as the primary refrigerant. The refrigeration system 210 includes a primary refrigeration circuit 212 that incorporates a thermal storage unit 214 containing a PCM 216. The primary refrigeration circuit 212 is in thermal communication with a thermal storage unit 214 so that heat can be transferred from the primary refrigeration circuit 212 to the thermal storage unit 214 and from the thermal storage unit 214 to the primary refrigeration circuit 212. The PCM 216 can be charged by the primary refrigeration circuit 210 to cool and/or solidify the PCM 210. The PCM 216 can also be used to absorb heat from the primary refrigeration circuit 210.

The refrigeration system 210 includes a receiver 218 for collecting condensed refrigerant and distributing the condensed refrigerant to one or more downstream loads. The receiver 218 receives condensed refrigerant from an inlet conduit 220. An outlet conduits 222 direct refrigerant from the receiver 218 to the one or more loads. The downstream loads can include one or more refrigerated merchandisers, operating at one or more temperatures. The exemplary embodiment shown in FIG. 3 depicts a medium temperature load 224 and a low temperature load 226 which represent refrigerated merchandisers used in a commercial environment. The number and type of merchandisers can be varied depending on the retail environment, and various exemplary embodiments can vary or eliminate the number of loads used in the primary refrigeration circuit 212.

A medium temperature conduit 228 branches off from the outlet conduit 222 to direct refrigerant to the medium temperature load 224. A medium temperature expansion valve 230 (e.g., an electronic expansion valve) is positioned between the receiver 218 and the medium temperature load 224 to regulate the pressure of the refrigerant entering the medium temperature load 224. The medium temperature conduit 228 connects to a first suction line 234 downstream of the medium temperature load 224.

A low temperature conduit 240 branches off from the outlet conduit 222 to direct refrigerant to the low temperature load 226. A low temperature expansion valve 242 (e.g., an electronic expansion valve) is positioned between the receiver 218 and the low temperature load 226. The low temperature expansion valve 242 regulates the pressure of the refrigerant entering the low temperature load 226. The low temperature conduit 240 connects to a second suction line 244 downstream of the low temperature load 226.

A pair of first compressor assemblies 250 and a pair of second compressor assemblies 252 are positioned downstream of the medium and low temperature loads 224, 226. FIG. 3 depicts two first compressor assemblies 250 associated with the low temperature load 226 and two second compressor assemblies 252 associated with the medium temperature load 224. Other embodiments can include a single compressor for all of the loads, a dedicated compressor for each load, or more than two dedicated compressors for each load.

Refrigerant from the low temperature load 226 is compressed by the first compressor assemblies 250 to a first pressure. After exiting the first compressor assemblies 250, refrigerant is directed through a low temperature inlet conduit 246 to the receiver 218. In other embodiments, refrigerant from the first compressor assemblies 250 can be directed to the second compressors 252. Refrigerant from the medium temperature load 224 is compressed by the second compressor assemblies 252 to a second pressure.

A bypass conduit 254 is coupled between the receptacle 218 and the return conduit 232 downstream of the second compressors 252. The bypass conduit 254 can circulate the refrigerant from the receptacle 218 to the second compressors 252 without passing through the medium temperature or low temperature loads 224, 226. In an exemplary embodiment, $CO_2$ vapor or gas is circulated from the receiver 218 to the second compressors 252. A valve (not shown) can control the flow of the refrigerant through the bypass conduit.

After passing through the second compressor assemblies 252, the refrigerant is directed to a heat exchanger, for example a condenser assembly 258 that includes a fin-tube heat exchanger 260 and a fan 262. As the compressed refrigerant enters the condenser assembly 258, the fan 262 draws air over the fin-tube heat exchanger 260 to extract heat from the refrigerant. This condenses the refrigerant prior to it being directed to the receiver 218 through the inlet conduit 220.

The refrigeration system 210 is configured so that the refrigerant can be used to charge the PCM 216. A charging conduit 264 branches off from the outlet conduit 222 to direct refrigerant to the thermal storage unit 214. The charging conduit 264 can be connected to the outlet conduit 222 by a valve 266 (e.g., a three-way valve). The charging conduit 264 connects to a first inlet/outlet conduit 268 via a valve 270 (e.g., a three-way valve). An expansion valve 272 (e.g., an electronic expansion valve) is positioned upstream from the thermal storage unit 214. The expansion valve 272 regulates the pressure of the refrigerant entering the thermal storage unit 214.

In the thermal storage unit 214 the refrigerant absorbs heat from the PCM 216, reducing the temperature of, and solidifying, the PCM 216. After passing through the thermal storage unit 214 the refrigerant enters a second inlet/outlet conduit 274. The refrigerant is then directed to a secondary compressor 276. The secondary compressor 276 is configured to compress the refrigerant to a third pressure. In certain embodiments, the second pressure can be equal to the third pressure. After exiting the secondary compressor 276, the refrigerant is returned to the condenser assembly 258. The flow of the refrigerant in this scenario is shown following arrows D1.

The refrigeration system 210 is also configured so that the thermal storage unit 214 can provide cooling to the refrigerant. Refrigerant exiting the condenser assembly 258 is directed through a valve 278 (e.g., a three-way valve) to a discharging conduit 280. The discharging conduit 280 is connected to the second inlet/outlet conduit 274 through a valve 282. Refrigerant flows through the second inlet/outlet conduit 274 into the thermal storage unit 214 where heat from the refrigerant is absorbed by the PCM 216, which can cause the PCM 216 to change from a solid to a liquid. After passing through the thermal storage unit 214, the refrigerant passes through a second bypass conduit 284 and a check valve 286, and is then directed to a secondary inlet conduit 288 by the valve 270. The secondary inlet conduit 288 connects to the receiver 218. The flow of the refrigerant in this scenario is shown following arrows D2.

Figure 4:
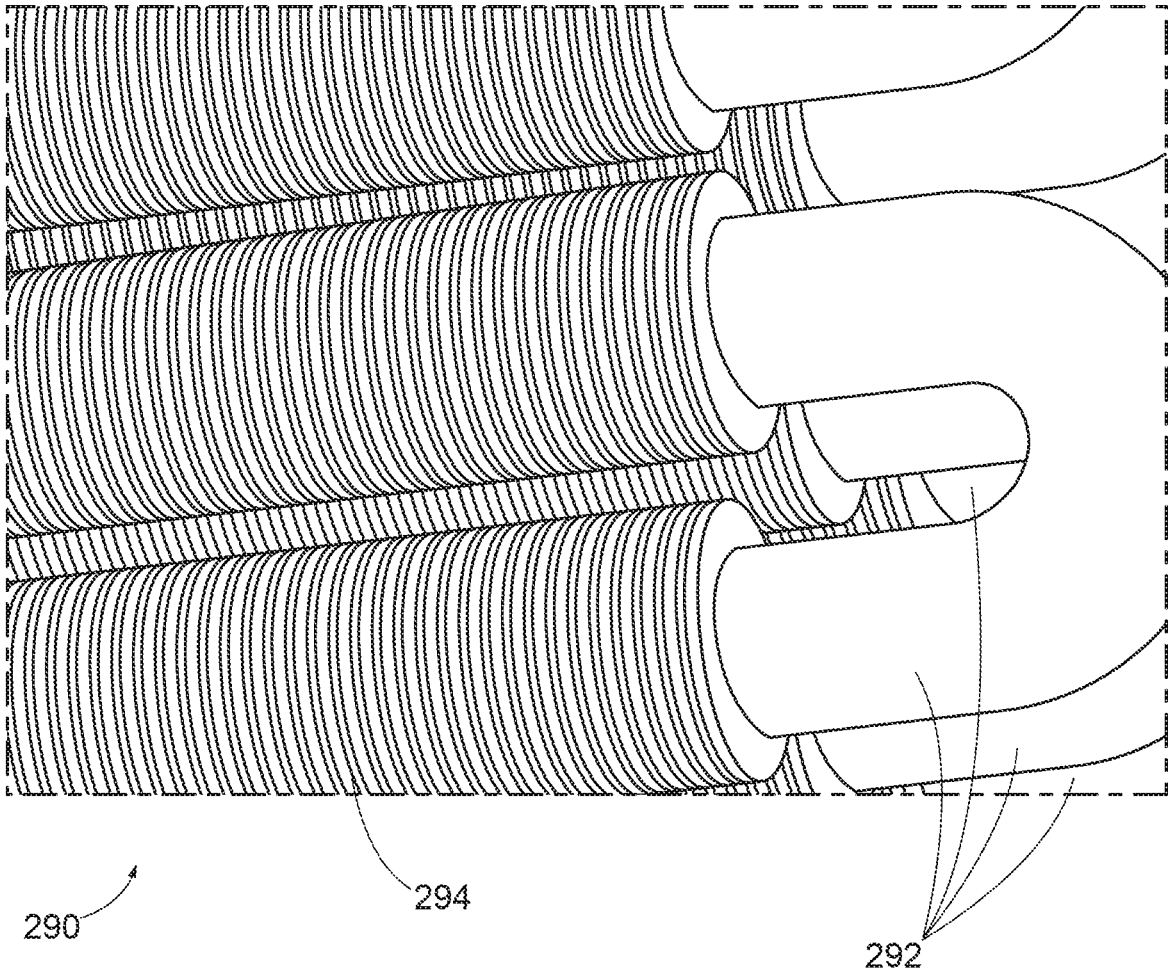
FIG. 4 is a partial view of a fin-tube heat exchanger that can be used as a heat exchanger in the refrigeration system of FIG. 3.

At least a portion of the thermal storage unit 214 contains or acts as a heat exchanger to transfer heat between the refrigerant and the PCM 216. In an exemplary embodiment, the thermal storage unit contains a finned-tube heat exchanger 290 having multiple tube loops 292 with fins 294 extending from the tubes. An example of this structure is shown in FIG. 4. The use of the finned-tube heat exchanger 290 creates a direct expansion method of cooling the PCM by directly expanding the primary refrigerant within the finned-tube heat exchanger 290.

The refrigeration system 210 is configured for subcritical operation using a $CO_2$ refrigerant as the primary refrigerant. Subcritical operation of the refrigeration system 210 is partially dependent on the temperature of the ambient environment. If the temperature of the ambient environment goes above $CO_2$'s critical temperature, $CO_2$ will not fully condense in the condenser assembly and the system becomes transcritical. At this stage the condenser can operate at least partially as a gas cooler or desuperheater to remove some of the heat from the refrigerant. The refrigerant is passed to the thermal storage unit 214 which acts as a condenser to absorb heat from, and fully condense, the refrigerant.

Under certain conditions, it will not be feasible to operate the system shown in FIG. 3 as subcritical for longer than specific period of time. For example, if the ambient temperature causes the refrigerant to rise above its critical temperature for an extended period of time, the PCM 216 will eventually lose the ability to condense the refrigerant. In such instances, the system 210 can be configured run as a subcritical system in a first temperature range, as a transcritical system in a second temperature range that is greater than the first temperature range, and then again as a subcritical system in a third temperature range that is greater than the first temperature range. The different temperature ranges can be varied depending on the typical ambient temperatures for a given region, the overall requirements of the system, and/or on the amount and thermal properties of the PCM 216. In an exemplary embodiment, the first temperature range can be below approximately 77° F., the second temperature range can be in the range of approximately 77° F. to approximately 95° F., and the third temperature range can be above approximately 95° F.

In various exemplary embodiments, the thermal storage unit 214 can be incorporated into the condenser assembly 258. The thermal storage unit 214 can be in the same housing as the condenser assembly 258 and a series of valves can be used to direct the primary refrigerant through the thermal storage unit 214 as needed prior to entering the condenser assembly 258 to cool the primary refrigerant. The valves can also route the primary refrigerant through the thermal storage unit 214 after passing through the condenser assembly 258 to charge the PCM 216. Accordingly, a separate heat exchanger, for example a fin-tube heat exchanger, can be positioned in the thermal storage unit to transfer heat between the PCM 216 and the primary refrigerant.

Various features and advantages of the invention are set forth in the following claims.

The invention claimed is:

1. A refrigeration system comprising:

a primary refrigeration circuit configured to circulate a $CO_2$ primary refrigerant, the primary refrigeration circuit including a compressor assembly, a condenser assembly, a receiver, and one or more refrigeration loads having an evaporator assembly; and a secondary refrigeration circuit separate from the primary refrigeration circuit and including a thermal storage unit and a heat exchanger, the thermal storage unit containing a phase change material, wherein the secondary refrigeration circuit is in thermal communication with the primary refrigeration circuit through the heat exchanger, wherein the primary refrigerant includes a critical temperature, wherein the primary refrigeration circuit is configured for subcritical operation such that the $CO_2$ primary refrigerant remains at or below a critical temperature, wherein the primary refrigeration circuit and the secondary refrigeration circuit are configured such that the phase change material provides cooling to the primary refrigerant during a first operating condition, and wherein the phase change material is configured to maintain subcritical operation of the primary refrigeration circuit during the first operating condition when the primary $CO_2$ refrigerant would otherwise be above the critical temperature.

2. The refrigeration system of claim 1, wherein the one or more refrigeration loads includes a low temperature refrigerated merchandiser and a medium temperature refrigerated merchandiser.

3. The refrigeration system of claim 1, wherein the secondary refrigeration circuit is configured to circulate a secondary refrigerant and the phase change material contained in the thermal storage unit is separate from the secondary refrigerant.

4. The refrigeration system of claim 1, wherein the heat exchanger is a discharging heat exchanger and the secondary refrigeration circuit includes a charging heat exchanger.

5. The refrigeration system of claim 4, wherein the primary refrigeration circuit and the secondary refrigeration circuit are configured such that the primary refrigerant provides cooling to the phase change material through the charging heat exchanger.

6. The refrigeration system of claim 1, wherein the primary refrigeration circuit is configured for subcritical operation in a first ambient temperature range and a second ambient temperature range, and is configured for transcritical operation in a third ambient temperature range.

7. The refrigeration system of claim 6, wherein the first ambient temperature range is below approximately 77° F., the second ambient temperature range is above approximately 95° F., and the third ambient temperature range is between approximately 77° F. and approximately 95° F.

8. The refrigeration system of claim 1, wherein the primary refrigeration circuit includes a condenser conduit, wherein the condenser conduit is in communication with the heat exchanger.

9. The refrigeration system of claim 8, wherein the condenser conduit is connected to an inlet conduit by a valve positioned between the condenser assembly and the receiver.

10. The refrigeration system of claim 8, wherein the condenser conduit is connected to an adiabatic cooler in communication with the condenser assembly.

11. A refrigeration system comprising:

a $CO_2$ refrigerant having a critical temperature;

a receiver configured to retain the $CO_2$ refrigerant;

one or more refrigeration loads having an evaporator assembly and in fluid communication with the receiver;

a compressor assembly in fluid communication with the refrigeration loads;

a condenser assembly in fluid communication with the compressor assembly; and a thermal storage unit in fluid communication with the condenser assembly and the receiver, wherein the thermal storage unit includes a heat exchanger and phase change material, wherein the phase change material provides cooling to the $CO_2$ refrigerant during a first operating condition when the $CO_2$ refrigerant would otherwise be above the critical temperature, and wherein the $CO_2$ refrigerant is configured to cool the phase change material during a second operating condition when the $CO_2$ refrigerant is below the critical temperature.

12. The refrigeration system of claim 11, wherein during the first operating condition the $CO_2$ refrigerant is directed from the condenser assembly to the thermal storage unit prior to entering the receiver.

13. The refrigeration system of claim 11, wherein the heat exchanger includes a fin-tube heat exchanger.

14. The refrigeration system of claim 11, wherein in a third operating condition the $CO_2$ refrigerant is directed from the condenser assembly to the receiver and from the receiver to the one or more refrigeration loads without entering the thermal storage unit.

15. The refrigeration system of claim 11, wherein during the second operating condition the $CO_2$ refrigerant is directed from the receiver to the thermal storage unit.

16. The refrigeration system of claim 15, wherein during the second operating condition the $CO_2$ refrigerant is directed from the thermal storage unit to a secondary compressor assembly.

17. A method of controlling a refrigeration system including a $CO_2$ refrigerant having a critical temperature, a receiver configured to retain the $CO_2$ refrigerant, one or more refrigeration loads having an evaporator assembly and in fluid communication with the receiver, a compressor assembly in fluid communication with the refrigeration loads, a condenser assembly in fluid communication with the compressor assembly, and a thermal storage unit in fluid communication with the condenser assembly and the receiver, wherein the thermal storage unit includes a heat exchanger and phase change material, the method comprising:

directing the $CO_2$ refrigerant to the thermal storage unit to cool the $CO_2$ refrigerant with the phase change material during a first operating condition when the $CO_2$ refrigerant would otherwise be above the critical temperature; and directing the $CO_2$ refrigerant to the thermal storage unit to charge the phase change material during a second operating condition when the $CO_2$ refrigerant is below the critical temperature.

18. The method of claim 17, wherein during the first operating condition the $CO_2$ refrigerant is directed from the condenser assembly to the thermal storage unit prior to entering the receiver.

19. The method of claim 17, wherein in a third operating condition the $CO_2$ refrigerant is directed from the condenser assembly to the receiver and from the receiver to the one or more refrigeration loads without entering the thermal storage unit.

20. The method of claim 17, wherein during the second operating condition the $CO_2$ refrigerant is directed from the receiver to the thermal storage unit.

21. The method of claim 20, wherein during the second operating condition the $CO_2$ refrigerant is directed from the thermal storage unit to a secondary compressor assembly.

* * * * *